US010135180B2

(12) United States Patent
Sturgess et al.

(10) Patent No.: US 10,135,180 B2
(45) Date of Patent: Nov. 20, 2018

(54) CONTACT ELEMENT

(71) Applicant: Stäubli Electrical Connectors AG, Allschwil (CH)

(72) Inventors: Mark Sturgess, Basel (CH); Falk Blumenroth, Rheinfelden (DE); Tom Ledermann, Riehen (CH); Lucas Wirz, Basel (CH)

(73) Assignee: Stäubli Electrical Connectors AG, Allschwil (CH)

( * ) Notice: Subject to any disclaimer, the term of this patent is extended or adjusted under 35 U.S.C. 154(b) by 0 days.

(21) Appl. No.: 14/777,921

(22) PCT Filed: Mar. 6, 2014

(86) PCT No.: PCT/EP2014/054344
§ 371 (c)(1),
(2) Date: Sep. 17, 2015

(87) PCT Pub. No.: WO2014/146905
PCT Pub. Date: Sep. 25, 2014

(65) Prior Publication Data

US 2016/0226181 A1 Aug. 4, 2016

(30) Foreign Application Priority Data

Mar. 18, 2013 (EP) ..... 13159718

(51) Int. Cl.
*H01R 13/625* (2006.01)
*H01R 13/622* (2006.01)
(Continued)

(52) U.S. Cl.
CPC ..... *H01R 13/622* (2013.01); *H01R 4/4881* (2013.01); *H01R 13/03* (2013.01); *H01R 13/187* (2013.01)

(58) Field of Classification Search
CPC .. H01R 9/0518; H01R 9/0524; H01R 4/4881; H01R 13/622
See application file for complete search history.

(56) References Cited

U.S. PATENT DOCUMENTS 5,261,840 A * 11/1993 Benz ..... H01R 4/4881 439/843
5,577,928 A 11/1996 Duclos
(Continued)

FOREIGN PATENT DOCUMENTS

CN 1120746 A 4/1996
CN 1602566 A 3/2005
(Continued)

*Primary Examiner* — Abdullah Riyami
*Assistant Examiner* — Nader Alhawamdeh
(74) *Attorney, Agent, or Firm* — The Webb Law Firm

(57) ABSTRACT

A contact element comprises at least two strips and a row of webs, which are arranged between the strips and are contiguous with the strips, wherein the webs are connected resiliently to one of the strips via torsion sections and are inclined with respect to the strips in the deformed state, with the result that a first contact section extends above the strip and a second contact section extends below the strip, wherein the webs each have a front web rim and a rear web rim, which front web rim has a bulge, and which rear web rim has an indentation, which fits or is complementary to the bulge of a directly adjacent web rim, wherein the bulge provides said front contact section, and wherein the webs, to the side of the indentation, have two rear web sections, which provide the second contact section.

19 Claims, 7 Drawing Sheets

(51) Int. Cl.

| | |
|---|---|
| ***H01R 4/48*** | (2006.01) |
| ***H01R 13/187*** | (2006.01) |
| ***H01R 13/03*** | (2006.01) |

(56) References Cited

U.S. PATENT DOCUMENTS

| | | | | |
|---|---|---|---|---|
| 6,196,886 | B1 | | 3/2001 | Sato |
| 6,547,607 | B2 | | 4/2003 | Moll et al. |
| 6,837,756 | B2 | | 1/2005 | Swearingen et al. |
| D574,776 | S | | 8/2008 | Munch et al. |
| D574,777 | S | | 8/2008 | Munch et al. |
| D577,676 | S | | 9/2008 | Munch et al. |
| D579,414 | S | | 10/2008 | Munch et al. |
| 7,682,207 | B2 | | 3/2010 | Clark |
| D617,740 | S | | 6/2010 | Fennell |
| 7,775,840 | B2 | | 8/2010 | Matsumoto et al. |
| 8,057,269 | B2 | | 11/2011 | Ledermann et al. |
| D657,312 | S | | 4/2012 | Aragon et al. |
| 8,668,531 | B2 | | 3/2014 | Yamaguchi et al. |
| 8,827,755 | B2 | | 9/2014 | Blakborn |
| D748,063 | S | | 1/2016 | Buck et al. |
| D749,523 | S | | 2/2016 | Todo et al. |
| D749,524 | S | | 2/2016 | Todo et al. |
| D750,025 | S | | 2/2016 | Buck et al. |
| D751,510 | S | | 3/2016 | Todo et al. |
| D751,511 | S | | 3/2016 | Buck et al. |
| D751,992 | S | | 3/2016 | Buck et al. |
| D753,066 | S | * | 4/2016 | Sturgess ..... D13/154 |
| D758,971 | S | | 6/2016 | Arichika et al. |
| D760,169 | S | | 6/2016 | Ohsaka |
| D768,089 | S | | 10/2016 | Liu |
| D769,196 | S | | 10/2016 | Yokoyama |
| 2007/0218736 | A1 | | 9/2007 | Takizawa et al. |
| 2008/0271921 | A1 | * | 11/2008 | Hengel ..... H01R 4/4881 174/88 B |
| 2009/0029605 | A1 | * | 1/2009 | Matsumoto ..... H01R 13/187 439/843 |
| 2009/0269993 | A1 | | 10/2009 | Zhang |
| 2010/0093230 | A1 | * | 4/2010 | Ledermann ..... H01R 13/187 439/842 |
| 2010/0248508 | A1 | | 9/2010 | Neumetzler |
| 2014/0099843 | A1 | * | 4/2014 | Ito ..... H01R 13/02 439/884 |
| 2016/0134030 | A1 | | 5/2016 | Ohkubo et al. |
| 2016/0156127 | A1 | | 6/2016 | Nomura et al. |

FOREIGN PATENT DOCUMENTS

| | | | |
|---|---|---|---|
| CN | 101567501 | B | 6/2012 |
| EP | 0520950 | A1 | 6/1992 |
| GB | 1469020 | | 3/1977 |
| JP | 5251156 | A | 9/1993 |
| JP | 2012238500 | A | 12/2012 |
| JP | 2012252975 | A | 12/2012 |

* cited by examiner

CONTACT ELEMENT

CROSS-REFERENCE TO RELATED APPLICATIONS

This application is the United States national phase of International Application No. PCT/EP2014/054344 filed Mar. 6, 2014, and claims priority to European Patent Application No. 13159718.9 filed Mar. 18, 2013, the disclosures of which are hereby incorporated in their entirety by reference.

TECHNICAL FIELD

The present invention relates to a contact element for establishing an electrical contact between two electrical conductor elements or contact parts in accordance with the preamble of claim 1.

PRIOR ART

A generic contact element is known from EP 0 520 950. The contact element according to EP 0 520 950 comprises two strips, which are connected to one another by resilient webs. The webs can pivot relative to the strips, wherein a torsional force acts on the connection point between web and strip.

EP 0 520 950 has a series of disadvantages. Due to the shaping of the web, the degree of deformation in the region of the connection point is relatively high, which results in high stresses in the region of the connection point. The use of a high-strength copper alloy, in particular a high-strength beryllium-containing copper alloy, is thus necessary. Alloys of this type are very expensive, and beryllium may have effects that are harmful to health when it is released.

DISCLOSURE OF THE INVENTION

Proceeding from this prior art, the object of the invention is to specify a contact lamella or a contact element that overcomes the disadvantages of the prior art. In particular, the contact element should be more robust so that the number of contact operations can be increased.

This object is achieved by the subject matter of claim 1. A contact element according to claim 1 is used to establish an electrical contact between two electrical conductors or contact parts. The electrical conductors or contact parts, respectively, may be shaped differently and for example may be in the form of a plug and socket connection or a connection between two surface contacts with flat or planar conductors or contact parts, respectively. The contact element according to claim 1 comprises at least two strips extending parallel to one another and along or parallel, respectively, to or in the direction of a longitudinal axis and a row of webs, which are arranged between the strips and are contiguous with the strips. The webs are each connected resiliently via a first torsion portion to one of the strips and via a second torsion portion to another of the strips. Furthermore, the webs are inclined or angled with respect to the strips in the deformed state, such that a first contact portion extends above the strip and a second contact portion extends below the strip. The contact portions are provided by the web. The webs each have a front web edge and a rear web edge, which front web edge has a bulge and which rear web edge has an indentation, which fits or is complementary to the bulge of a directly adjacent web edge. The bulge provides said first contact portion. Furthermore, the webs, to the side of the indentation, have two rear web portions, which provide the second contact portion. An electrical contact is produced via the contact portions between the web and the electrical conductor or the contact part, respectively. The front web edge and the rear web edge extend from the first torsion portion to the second torsion portion. Furthermore, the front web edge and the rear web edge of two directly adjacent webs contact one another in the undeformed state over their entire length, in particular at least approximately. The front web edge and the rear web edge are particularly preferably in direct contact with one another.

The design of the web edges has the advantage that a contact element of this type can be produced efficiently with maximum utilization. In particular, the punch waste can be reduced.

Furthermore, a maximum extent of the web can be achieved as viewed in the longitudinal direction. The web as such is lengthened from the first contact portion to the second contact portion, as viewed in the direction of the longitudinal axis. The angular movement when providing an electrical contact can thus be reduced compared with contact elements known from the prior art, which has the advantage that the torsion portions are relieved of mechanical stress. Thereby, for example, the service life can be increased. In addition, with unchanged stress in the torsion portion, greater contact paths can be provided. Although the latter does not directly increase the service life, it does have the fundamental advantage that the contact element can be used in a wide range of contact configurations, thus increasing the versatility.

In the deformed state the webs can pivot relative to the strips, wherein a rotation acts on the torsion portions. The torsion portions are resilient, such that the webs in a contact situation are pressed constantly against the contact parts by the spring effect, such that a defined electrical contact can be provided.

The front web edge and the rear web edge preferably extend parallel to one another and/or in a manner complementary to one another or fitting one another, respectively. In particular the front web edge and the rear web edge have an identical course to one another, wherein the distance between the front web edge and the rear web edge is in each case constant over the entire web width from the first torsion portion to the second torsion portion, as viewed in the longitudinal axis.

The torsion portion is preferably provided by a series of apertures arranged at regular distances from one another, wherein the torsion portion is formed in the region between two apertures arranged in direct succession in the longitudinal axis and adjacently. As viewed in the longitudinal axis, the torsion portion is thus delimited and defined by two apertures. In a transverse direction, which extends at right angles to the longitudinal direction, the torsion portions are delimited essentially by the extent of the apertures in the same direction. The torsion portion thus has substantially the same extent in the transverse direction as the aperture. Here, the apertures are the only areas punched in the region of the webs. In this regard, the punch waste can be limited to a minimum.

The front web edge preferably extends rearwardly from the bulge on either side of this bulge and defines a front side portion. This front side portion extends in portions substantially at right angles to the longitudinal axis, in particular in a region adjoining the torsion portion.

The rear web edge preferably extends rearwardly from the indentation on either side of this indentation and defines a rear side portion. This rear side portion extends in portions substantially at right angles to the longitudinal axis, in particular in a region adjoining the torsion portion, respectively.

The side portions are parts of the front web edge or of the rear web edge.

The front web edge particularly preferably transitions from the bulge to the front side portion via a rounded connection portion. The same can be said for the rear web edge, which transitions from the indentation to the rear side portion via a rounded connection portion.

In a preferred embodiment the front web edge is provided, as viewed from one strip to another strip, by a front side portion, a rounded connection portion, the bulge, a rounded connection portion and a further side portion. The specified portions adjoin one another in direct succession. The side portions lead into the respective torsion portion. In this preferred embodiment the rear web edge is provided, as viewed from one strip to another strip, by a rear side portion, a rounded connection portion, the indentation, a rounded connection portion and a further side portion. The specified portions adjoin one another in direct succession. The side portions lead into the torsion portion.

The web edges of two directly adjacent webs contacting one another particularly preferably lead jointly into the same aperture in the region of the one strip and in the region of the other strip. The front side portion and the rear side portion of two directly adjacent webs thus lead jointly into a common aperture, wherein the web portions, in the region of the junction, preferably extend at right angles to the strips.

The aperture preferably has a front portion and a rear portion, wherein the front portion and the rear portion preferably extend at right angles to the strips, and wherein the front portion and the rear portion are connected via two side portions, which preferably extend parallel to the strips. The aperture is thus delimited by the side portions and the front and also the rear portion. Transition regions between the portions delimiting the aperture are preferably formed in each case with a rounded portion.

The front web edge and the rear web edge or the side portions of the web edges, respectively, particularly preferably lead into the aperture in the region of the side portion of the aperture, but preferably not in the region of the rounded portion.

The webs arranged in direct succession along the strips are particularly preferably separated from one another in the region of the web edges by cuts made without material removal and contact one another in the undeformed state in particular at least approximately or approximately or entirely. Here, the expression "at least approximately" is to be understood to mean that the web edges are separated from one another merely by the cut.

The bulge preferably has an apex centrally between the two strips. A torsion line extends centrally through the torsion portion and at right angles to the longitudinal axis. The distance between apex and torsion line in the direction of the longitudinal axis is preferably substantially equal to the distance between torsion line and the rear web edge in the region of the rear web portions in the direction of the longitudinal axis. Alternatively, the distance between apex and torsion line in the direction of the longitudinal axis is greater or smaller by a factor in the range of 1.0 and 1.3, in particular 1.15 to 1.25, than the distance between torsion line and the rear web edge in the region of the rear web portions in the direction of the longitudinal axis.

The torsion portions are preferably deformed via a twisting during production. The web itself is preferably formed substantially as an even plane between the two torsion portions, apart from the bulge and the web portions extending laterally from the indentation, said even plane being arranged at an angle to the strips. The torsion portion could also be referred to as a resilient swivel joint.

The bulge and/or the web portions are preferably curved via a curvature with respect to the even plane. The curvature is preferably oriented towards the strips. Here, the curvature can provide the effective contact portion.

The strips are particularly preferably provided with a reinforcing corrugation, which extends in the direction of or parallel to the longitudinal axis, respectively. The reinforcing corrugation preferably has a u-shaped cross section and/or a rectangular cross section and/or a rounded cross section.

The height of the reinforcing corrugation in a direction perpendicular to the surface of the strip is particularly preferably less than the extent of the web in the corresponding direction with maximum deflection of the web. The conductors or contact parts, respectively, therefore do not come into contact with the reinforcing corrugation.

The contact element particularly preferably is or consists of, respectively, a beryllium-free metal alloy, in particular of a beryllium-free copper alloy. This material selection has the advantage that no beryllium is used during the production. The omission of beryllium, however, has the disadvantage that the strength of the material as a whole is reduced, whereby the maximum permissible stresses in the torsion portion are also lower. As a result of the longer design of the webs compared with the prior art, as described above, a reduced deformation of the torsion portions with the same path of deflection can be achieved. It is thus possible to compensate for the negative effect of the lower permissible maximum stress on account of the material selection.

The contact element is particularly preferably formed in one piece.

Further embodiments are specified in the dependent claims.

BRIEF DESCRIPTION OF THE DRAWINGS

Preferred embodiments of the invention will be described hereinafter with reference to the drawings, which serve merely for explanation and are not to be interpreted as limiting. In the drawings.

DESCRIPTION OF PREFERRED EMBODIMENTS

Figure 1A:
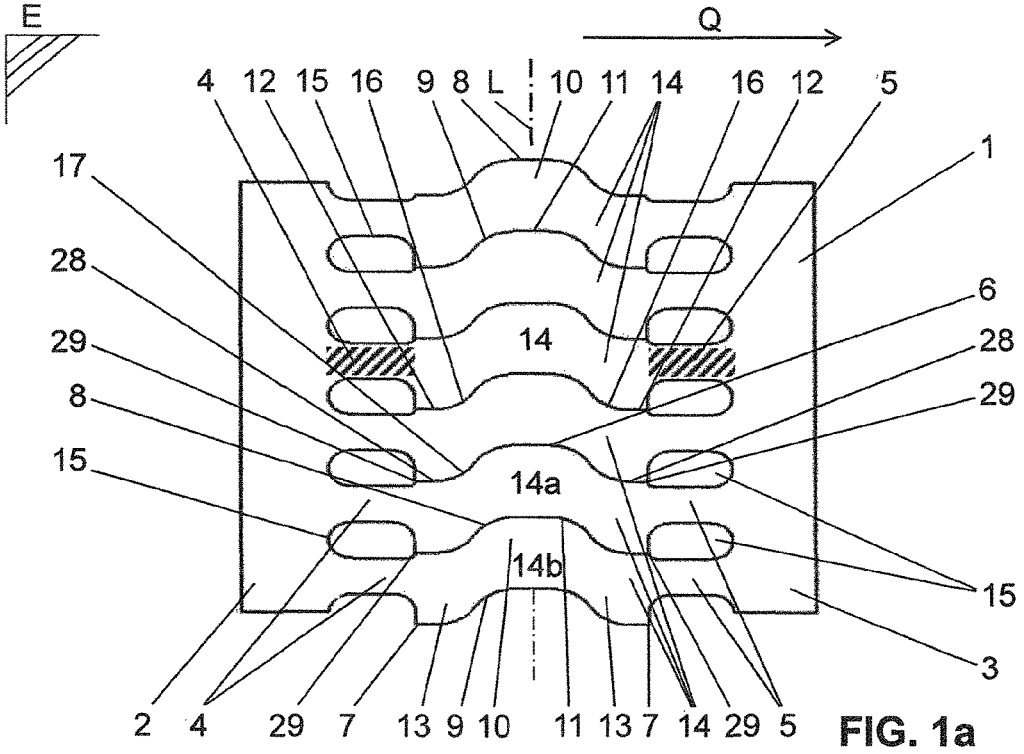
FIG. 1*a* shows a plan view of an embodiment of a contact element according to the invention in the undeformed state.
Figure 1B:
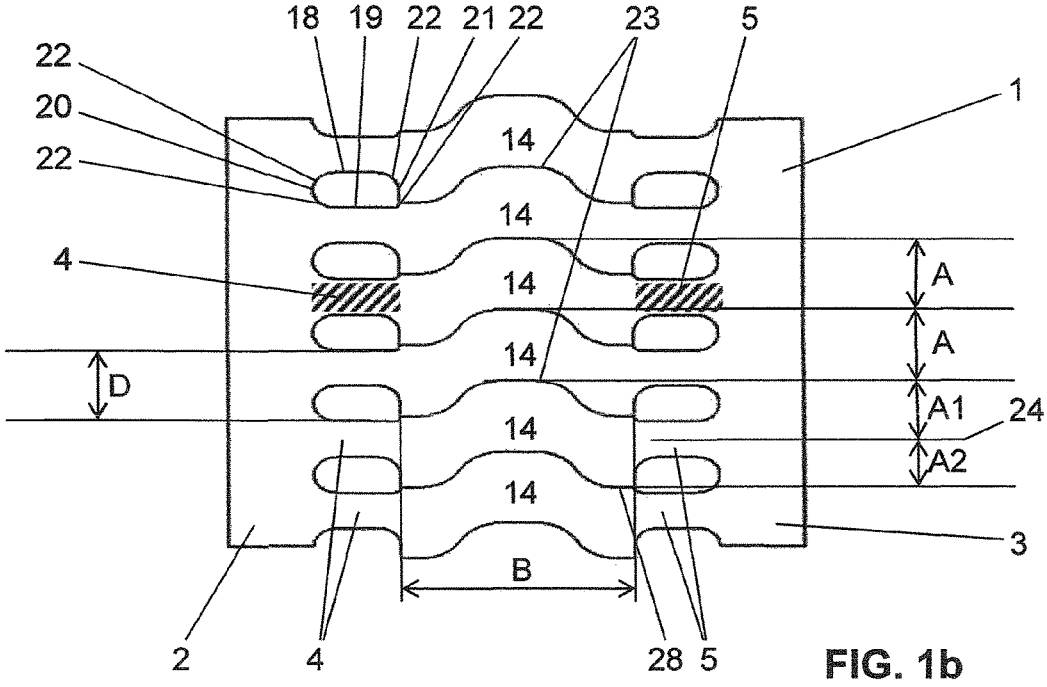
FIG. 1*b* shows a plan view according to FIG. 1*a* with further explanations.

FIGS. 1*a* and 1*b* show a contact element 1 for establishing an electrical contact between two electrical conductors. The contact element 1 can be connected to different electrical conductors. Reference is made here to a plug and socket connection by way of example. Alternatively, flat contacts can also be electrically conductively connected to the contact element.

The contact element in FIGS. 1*a*/1*b* is shown in the undeformed state. FIGS. 2 to 6 show the contact element in the deformed state. FIGS. 7 to 10 show exemplary situations of installation.

The contact element 1 comprises at least two strips 2, 3 extending parallel to one another and in the direction of or parallel to a longitudinal axis L, respectively. The strip 2 is arranged here at a distance from the strip 3. The two strips 2, 3 span a plane E with their surfaces and lie in this plane E in the undeformed and uninstalled state. The plane E essentially serves for the definition of some further elements. In the installed state the strips 2, 3 extend in the direction of a longitudinal axis or along a periphery of a plug or socket body, depending on the contact situation.

The strips 2, 3 are connected to one another via webs 14. The webs 14 bridge the gap between the two strips 2, 3. The webs 14 are essentially used to connect the first strip 2 to the second strip 3, wherein the webs 14 are connected here via torsion portions 4, 5 to the strips 2, 3. The webs 14 convey the effective electrical contact between the two conductors and can therefore also be referred to as contact webs 14. In the deformed state the webs 14 move resiliently with respect to the strips 2, 3.

The webs 14 are connected resiliently via a first torsion portion 4 to the first strip 2 and resiliently by means of a second torsion portion 5 to the second strip 3. The torsion portions 4, 5 are resilient and are used as a torsion joint for the webs 14. Each web 14 is assigned a first and a second torsion portion 4, 5. The resilient design on the one hand ensures a return of the webs 14 following cancellation of the electrical contact between the conductors and on the other hand ensures the provision of a force against the surfaces of the conductors in the contacted state, whereby a defined contact is provided between webs 14 and the conductors.

Figure 2:
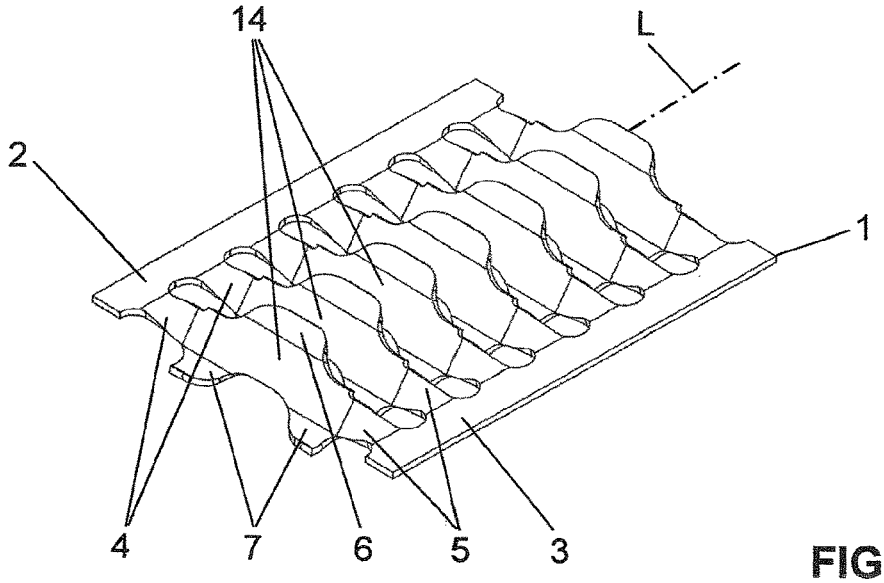
FIG. 2 shows a perspective view of the contact element according to FIG. 1 in the deformed state.
Figure 3:
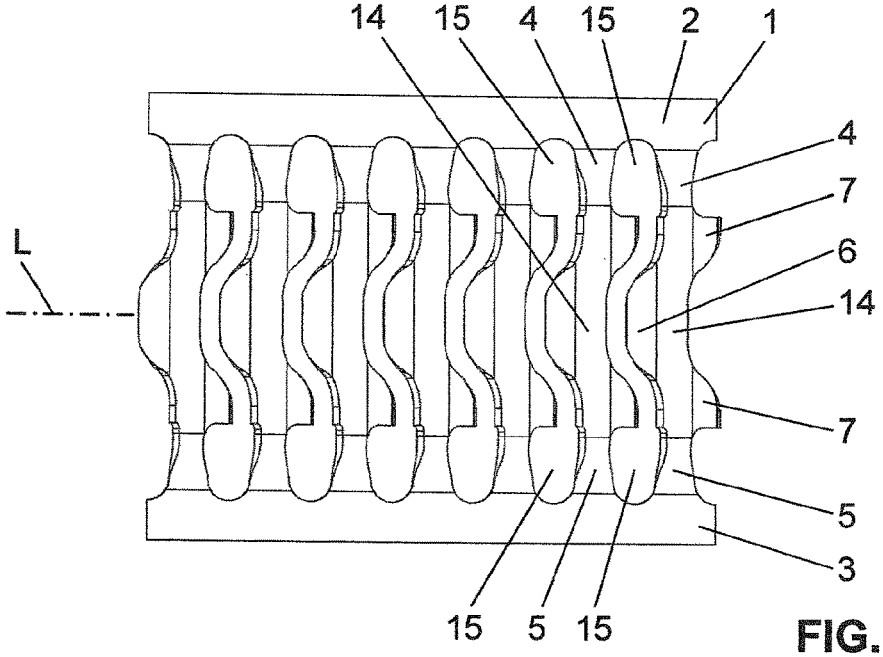
FIG. 3 shows a plan view of the contact element according to FIG. 2.
Figure 4:
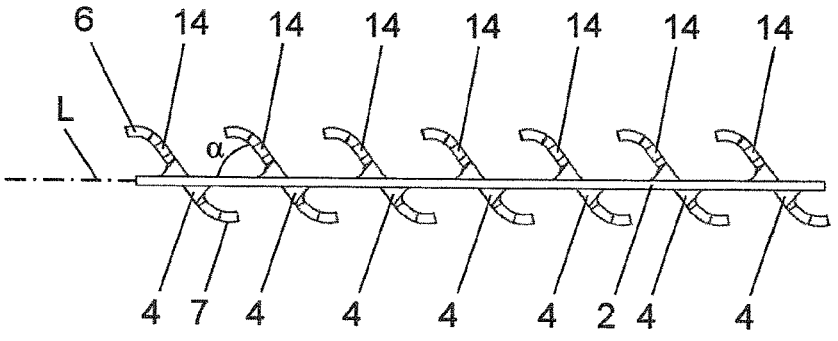
FIG. 4 shows a side view of the contact element according to FIG. 2.

It can be seen from FIG. 2 that the webs 14 in the deformed state are inclined or angled, respectively, with respect to the strips 2, 3. A first contact portion 6 of the web 14 extends above the strips 2, 3 and a second contact portion 7 extends below the strips 2, 3. This can also be seen particularly clearly in FIG. 4. The contact portions 6, 7 are used to contact the two conductors to be electrically connected. The first contact portion 6 here comprises a contact point, and the second contact portion 7 here comprises two contact points arranged at a distance from one another.

When establishing an electrical contact, the webs 14 are pivoted about the torsion portion 4, 5. Here, the angle of inclination a of the web 14 relative to the strips 2, 3 is decreased. The first contact portion 6 and the second contact portion 7 are thus moved toward the strips 2, 3. The contact element 1 is in contact via the contact portions 6, 7 with corresponding surfaces of the electrical conductors to be connected. The electrical contact between the conductor in question and the contact element 1 is provided via this contact. Here, the web 14 establishes the electrical contact between the conductors.

The form of the webs will now be explained in greater detail with reference to FIG. 1*a*.

Each of the webs 14 has a front web edge 8 and a rear web edge 9. The front web edge 8 has a bulge 10. The rear web edge has an indentation 11. Here, the indentation 11 of the one web 14 fits the bulge 10 of the directly adjacent web 14. Two directly adjacent webs are designated in FIG. 1 by the reference signs 14*a* and 14*b*. The front web 14*a* is in contact via its indentation 11 with the bulge 10 of the rear web 14*b*. The bulge 10 here fits or is complementary to the indentation 11. In other words it can also be said that the bulge 10 and the indentation 11 are in contact with one another.

The bulge 10 provides said first contact portion 6.

The webs 14, to the side of the indentation 11, have two rear web portions 13. These rear web portions 13 provide the second contact portion 7.

The front web edge 8 and the rear web edge 9 extend from the first torsion portion 4 to the second torsion portion 5. The torsion portions 4 and 5 are illustrated in FIG. 1*a* in a hatched manner in conjunction with a web 14. The front web edge 8 and the rear web edge 9 of two directly adjacent webs 14 contact one another in the undeformed state over their entire length. The term "contact" is understood to mean that the webs 14 are either in direct contact with one another or are distanced from one another to an extremely low extent in the region of a few hundreds or tenths of a millimeter. It can also be said that the front web edge 8 and the rear web edge 9 of two directly adjacent webs 14 contact one another at least approximately in the undeformed state. In FIG. 1 the webs 14*a* and 14*b* are two directly adjacent webs. The front web edge 8 of the web 14*b* is thus in contact with the rear web edge 9 of the web 14*a*.

The webs 14 of a contact element 1 are each formed identically to one another. This means that each web connecting the strip 2 to the strip 3 is formed identically to the adjacent web 14. Thereby, a defined electrical contact can be produced.

The front web edge 8 and the rear web edge 9 of a web 14 are preferably formed parallel to one another. The two web edges 8, 9 thus extend parallel to one another. The web over its entire width B thus has the same dimension in the direction of the longitudinal axis L. This dimension carries the reference sign A in FIG. 1*b*. The width B of the web 14 here is defined from the connection point between the web 14 and the first torsion portion 4 to the connection point between the web 14 and the second torsion portion 5. The web 14 thus extends from the first torsion portion 4 to the second torsion portion 5. The expression "parallel" is to be understood in this context to mean that the two web edges 8, 9 are parallel to one another, but do not necessarily extend at right angles to the longitudinal axis L.

The front web edge 8 is preferably complementary to or fits or is supplementary to the rear web edge 9, respectively. In other words this means that the front web edge 8 and the rear web edge 9 between the two torsion portions 4, 5 have an identical course, wherein the distance A between the front web edge 8 and the rear web edge 9 as viewed in the longitudinal axis L is constant over the entire web width B from the first torsion portion 4 to the second torsion portion 5.

The torsion portions 4, 5 are provided by a series of apertures 15 arranged at regular distances from one another. The apertures 15 are arranged between the webs 14 and the strips 2, 3. The remaining part between two apertures 15 here provides the torsion portion 4, 5. The torsion portion 4, 5 is thus formed by the region between two adjacent apertures 15 following one another directly in the longitudinal axis. The two apertures 15, which for example are arranged adjacently to the hatched torsion region 4, 5 thus form these said torsion portions 4, 5. The distance between two adjacent apertures corresponds substantially to the distance A between the front web edge 8 and the rear web edge 9 of a web 14. This distance carries the reference sign D.

The apertures 15 on the left in the case of the torsion portions 4 are arranged in mirror symmetry about the longitudinal axis L with respect to the apertures 15 on the right in the case of the torsion portions 5.

In the transverse direction Q, which is at right angles to the longitudinal axis L, the respective torsion portion 4, 5 extends over the maximum width of the aperture 15 in the same direction Q. The extent of the apertures 15 in the transverse direction thus defines the length of the torsion portion between the strips 2, 3 and the web 14.

All apertures 15 have the same cross section. In addition, the apertures 15 are arranged one behind the other in series as viewed in the direction of the longitudinal axis L. The form of the aperture 15, which also influences the form of the torsion portions 4, 5, will be explained below in greater detail.

The front web edge 8 extends, as viewed from the bulge 10, rearwardly on either side of this bulge 10. A portion 12 is thus defined, which extends from the bulge 10 to the respective torsion portion 4, 5. This portion 12 can be referred to as a front side portion. This front side portion 12 extends in the region of the torsion portions 4, 5 substantially at right angles to the longitudinal axis L and then transitions via a rounded connection portion 16 into the bulge 10. As viewed from the torsion portion 4, the web 14 adjoins the torsion portion 4 with the front side portion 12. The rounded connection portion 16 adjoins the front side portion 12 and transitions into the bulge 10. The bulge 10 then crosses the central axis or longitudinal axis L between the strip 2 and the strip 3 and then transitions into the rounded connection portion 16 and the front side portion 12, which is then in turn connected to the torsion portion 5.

The rear web edge 9 extends from the indentation 11 rearwardly on either side of this indentation 11. The rear web edge 9 defines a rear side portion 28, which extends substantially parallel to the front side portion 12. The region of the web 14 extending to the side of the indentation 11 forms the rear web portion 28, which provides the contact portion 7. The rear side portion 28 extends in portions at right angles to the longitudinal axis L and is connected via a rounded connection portion 17 to the indentation 11. As viewed from the torsion portion 4, the web 14 adjoins the torsion portion 4 with the rear side portion 28. The rounded connection portion 17 adjoins the rear side portion 28 and transitions into the indentation 11. The indentation 11 then crosses the central axis between the strip 2 and the strip 3 and then transitions into the rounded connection portion 17 and the rear side portion 28, which is then in turn connected to the torsion portion 5.

The front side portion 12 and the rear side portion 28 of two adjacent webs 14 lead jointly into a common aperture 15. The junction point bears the reference sign 29. The web portions 12, 28 preferably extend in the region of the junction point 29 at right angles to the strips 2, 3.

The aperture 15, as shown in FIG. 1*b*, has a front portion 18 and a rear portion 19. The front portion 18 and the rear portion 19 are at right angles to the strips 2, 3. The front portion 18 and the rear portion 19 are connected via two side portions 20, 21. The side portions 20, 21 extend preferably parallel to the strips 2, 3 or may be rounded. The transition regions 22 between the portions 18, 19, 20, 21, which delimit the aperture 15, are preferably formed with a rounded portion. Here, the rounded portion can be formed differently. The term "formed differently" for example is to be understood to mean different radii of curvature for different rounded portions.

The front web edge 8 and the rear web edge 9 of two adjacent webs 14 or the side portions 12, 28 of the web edges 8, 9 lead in the region of the side portion 21 into the aperture 15. The web edges 8, 9 or the side portions 12, 28, respectively, however, particularly preferably do not lead in the region of the rounded portion 22 into the aperture.

In the undeformed state, as is illustrated in FIG. 1*a*/1*b*, the webs 14 following one another directly along the strips 2, 3 are separated from one another in the region of the web edges 8, 9 by cuts formed without material removal. Thus, no material is removed from the contact element 1 between the web edges 8, 9. The web edges 8, 9 are provided merely by corresponding cuts. The web edges 8, 9 in the undeformed state thus contacted one another in particular at least approximately.

The bulge 10, centrally between the two strips 2, 3, has an apex 23. A torsion line 24 extends centrally through the torsion portion 4, 5 and at right angles to the longitudinal axis L. The torsion line 24 is thus arranged centrally between two adjacent apertures 15. The distance A1 between apex 23 and torsion line 24 in the direction of the longitudinal axis is substantially identical to the distance A2 between the torsion line 24 and the rear web edge 9 in the region of the rear web portions 13 in the direction of the longitudinal axis L. The distance A2 is thus defined as the distance between the torsion line 24 and the rear side portion 28 as viewed in the direction of the longitudinal axis L. In an alternative embodiment the distance A1 is greater or smaller than the distance A2 by a factor in the range of 1.0 and 1.3, in particular 1.15 to 1.25.

As illustrated in FIG. 2, the torsion portions 4, 5 are deformed, in particular twisted, during the production. As a result of this twisting, the torsion portions 4, 5 act as spring portions or spring joints. The web 14 between the two torsion portions 4, 5 is substantially an even plane, apart from the bulge 10 and web portions 13 extending to the side of the indentation 11. This plane is angled here with respect to the strips 2, 3 or the plane E, respectively. The angle is specified in FIG. 4 by reference sign a.

The contact element 1 described herein in accordance with all embodiments preferably is or consists of, respectively, a beryllium-free metal alloy, in particular of a beryllium-free copper alloy.

Figure 5:
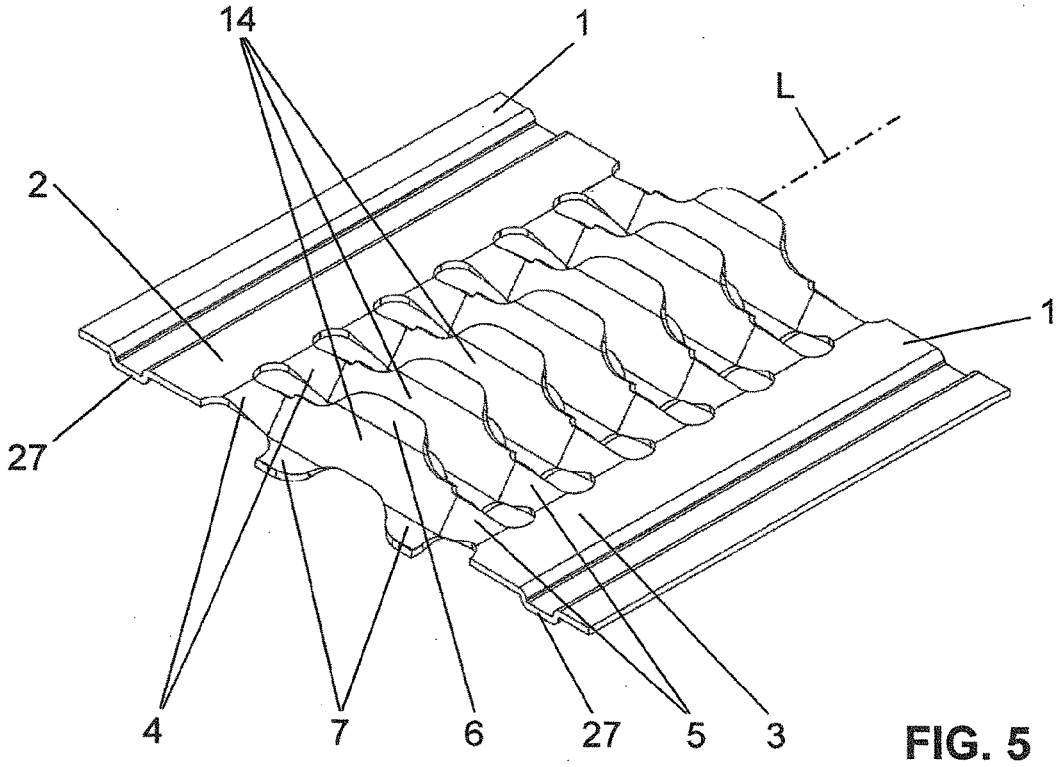
FIG. 5 shows a perspective view of the contact element according to FIG. 2 with reinforcing corrugations in accordance with a first embodiment.
Figure 6:
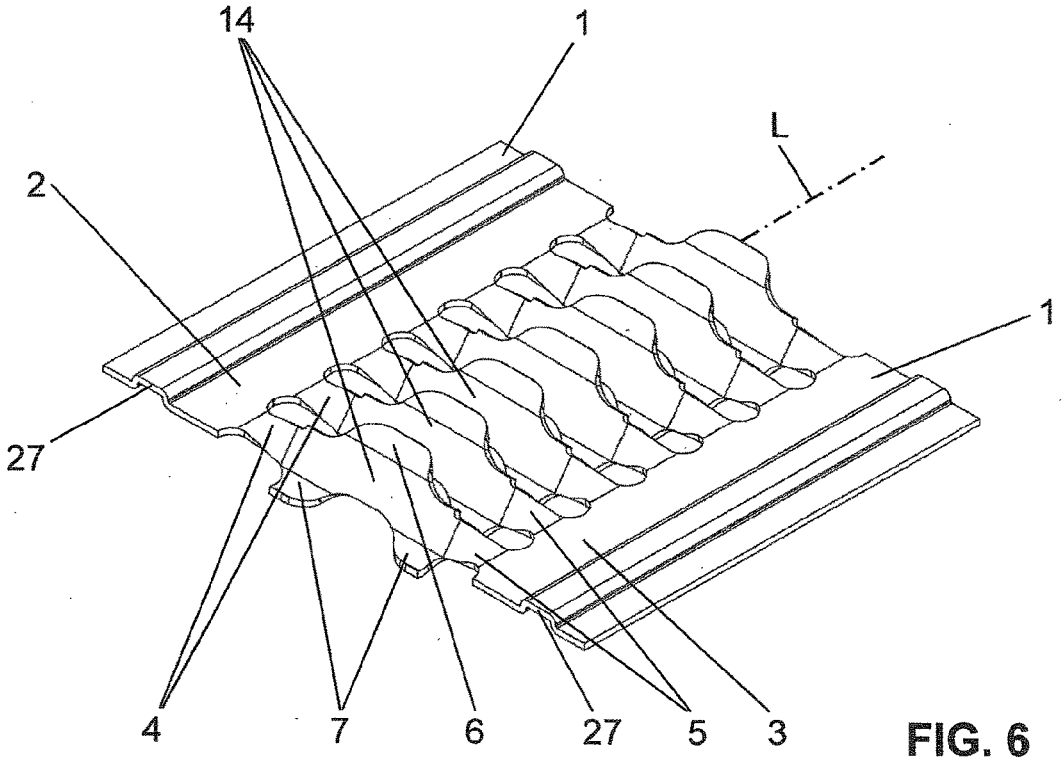
FIG. 6 shows a perspective view of the contact element according to FIG. 2 with reinforcing corrugations in accordance with a second embodiment.

Two further embodiments of the contact element 1 according to the invention are shown in FIGS. 5 and 6. The contact element as such, i.e. the strips 2, 3, the torsion portions 4, 5 and the webs 14, have substantially the above-described properties. In addition, the strips 2, 3 each have a reinforcing corrugation 27, which extends parallel to the longitudinal axis L. The inherent clamping force of the contact element can be increased in general via this reinforcing corrugation 27. The inherent clamping force is identified as the force with which the contact element braces itself radially in a groove extending about a central axis. This increase of the inherent clamping force is advantageous in particular with an installation of contact elements rolled in round form in a socket body or a plug body, because the installation in a groove or a recess with rectangular cross section, respectively, is thus allowed. Due to the inherent clamping force, the contact element 1 is pressed into the groove or the recess, respectively, or the contact element 1 is prevented from falling out of this groove or this recess, respectively. This is advantageous in particular with large diameters.

The reinforcing corrugation 27 also has advantages, however, in the case of flat installation. Flat installation configurations of this type will be presented with reference to FIGS. 9 to 12.

The reinforcing corrugation 27 can be oriented differently. In FIG. 5 the reinforcing corrugation 27 extends downwardly with respect to the contact portion 6 from the strips 2, 3 toward the contact portion 7. In FIG. 6 the arrangement is exactly the reverse. The reinforcing corrugation 27 may thus extend in the direction of the first contact portion 6 and/or in the direction of the second contact portion 7. It is also conceivable to arrange a number of reinforcing corrugations 27 adjacently, said reinforcing corrugations extending in the same and/or different directions.

In FIGS. 5 and 6 the reinforcing corrugations each have a u-shaped cross section. In other embodiments the cross section may also be formed differently, for example as a rectangular cross section and/or a rounded cross section.

Figure 7A:
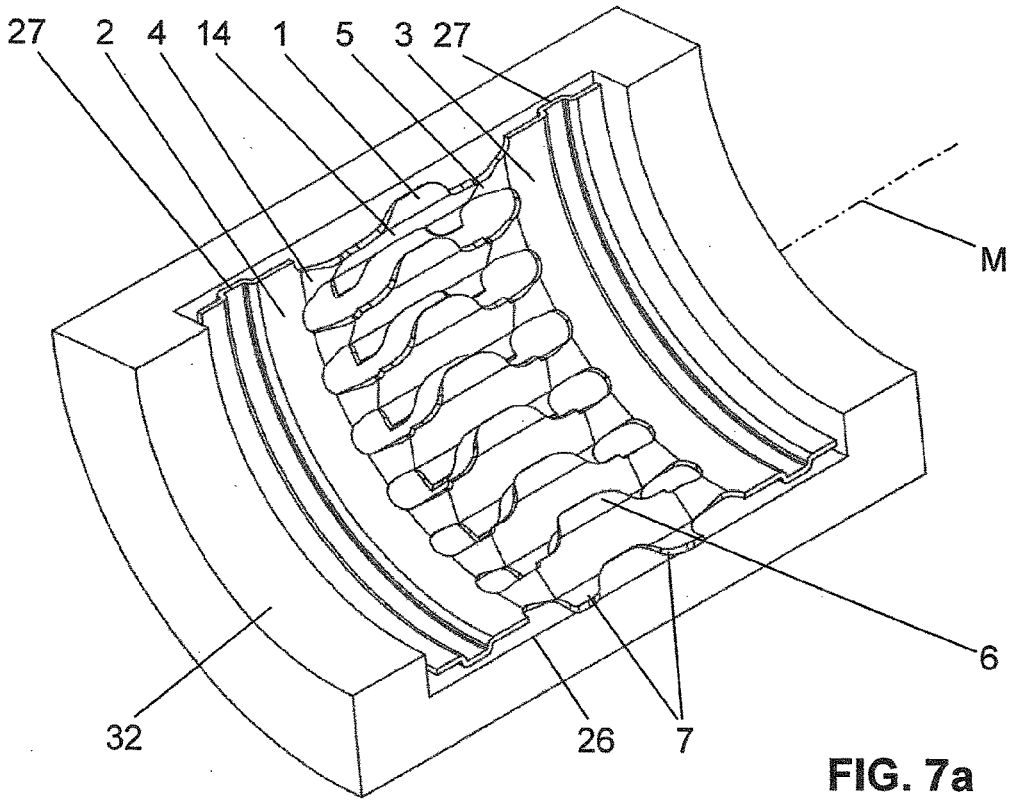
FIGS. 7*a*/7*b* show preferred variants of the installation of the contact lamella in a socket, wherein only a quarter of the socket is illustrated.
Figure 7B:
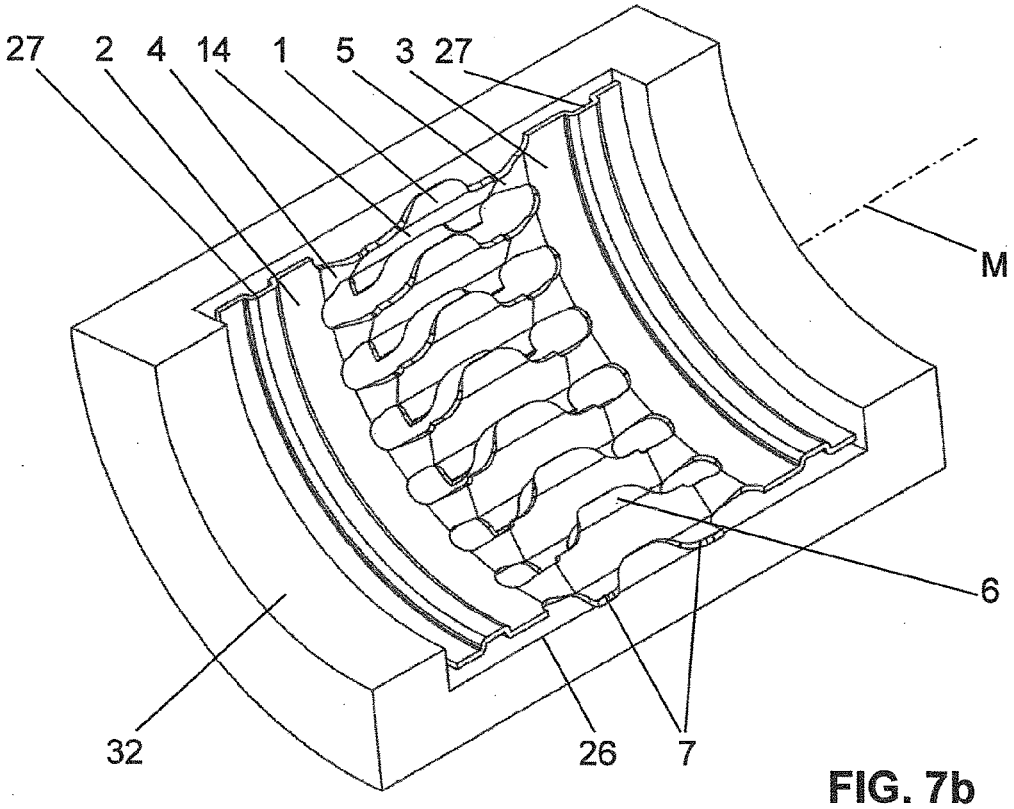

Two situations of installation of a contact element 1 having a reinforcing corrugation 27 in a recess 26 in a socket 32 are shown in FIGS. 7*a* and 7*b*. The socket 32 is shown here only in part. The contact element 1 lies here in a recess 26, which has a rectangular cross section. In FIG. 7*a* the reinforcing corrugation 27 extends toward the bottom of the recess 26. The reinforcing corrugation 27 thus extends in the direction of the second contact portions 7, which are in contact with the bottom of the recess 26. In FIG. 7*b* the reinforcing corrugation 27 extends away from the bottom of the recess 26. The reinforcing corrugation 27 thus extends in the direction of the first contact portions 6. The socket 32, of which only a quarter is shown, as already mentioned, extends completely around the central axis M.

Figure 8A:
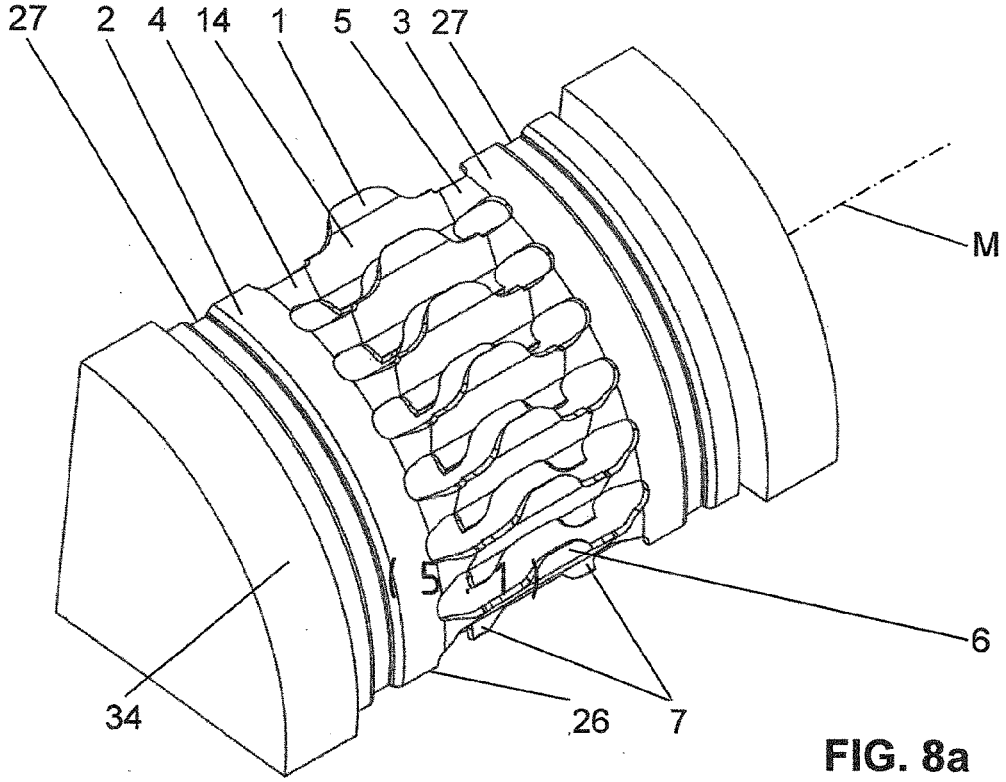
FIGS. 8*a*/8*b* show preferred variants of the installation of the contact lamella in a plug, wherein only a quarter of the plug is illustrated.
Figure 8B:
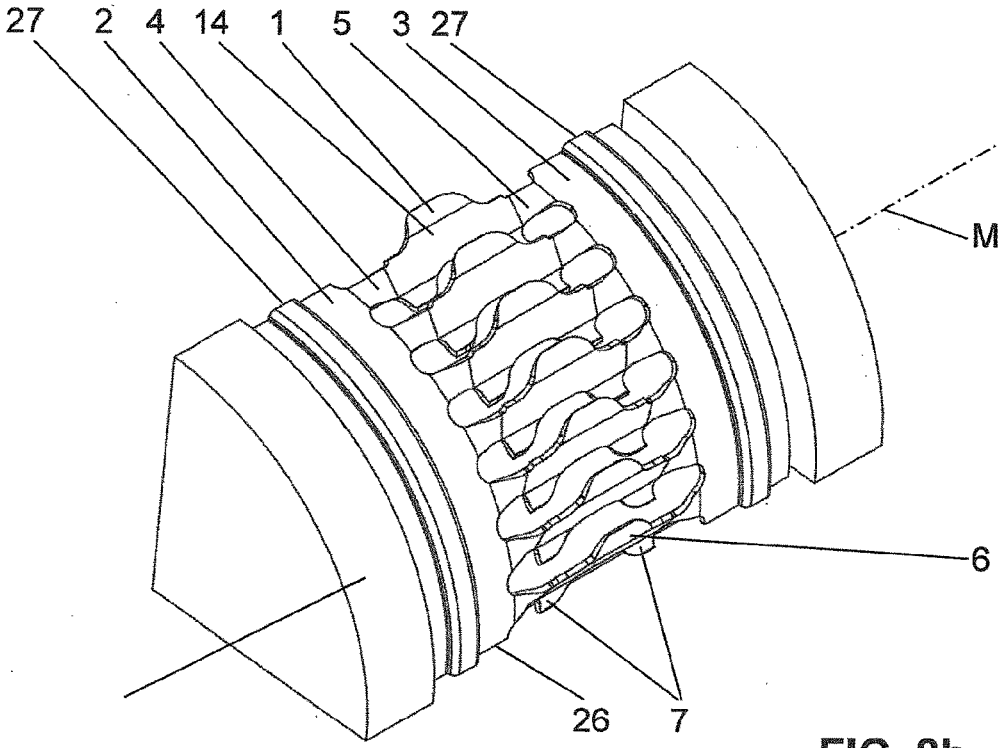

Two situations of installation of a contact element 1 having a reinforcing corrugation 27 in a recess 26 of a plug 34 are shown in FIGS. 8*a* and 8*b*. The plug 34 is shown here only in part. The contact element 1 lies here in a recess 26, which has a rectangular cross section. In FIG. 8*a* the reinforcing corrugation 27 extends toward the bottom of the recess 26. The reinforcing corrugation 27 thus extends in the direction of the second contact portions 7, which are in contact with the bottom of the recess 26. In FIG. 8*b* the reinforcing corrugation 27 extends away from the bottom of the recess 26. The reinforcing corrugation 27 thus extends in the direction of the first contact portions 6. The plug 34, of which only a quarter is shown, as already mentioned, extends completely about the central axis M.

Of course, contact elements 1 without the reinforcing corrugations 1 can also be inserted into the recesses 26 in the shown sockets or plugs, respectively.

Figure 9:
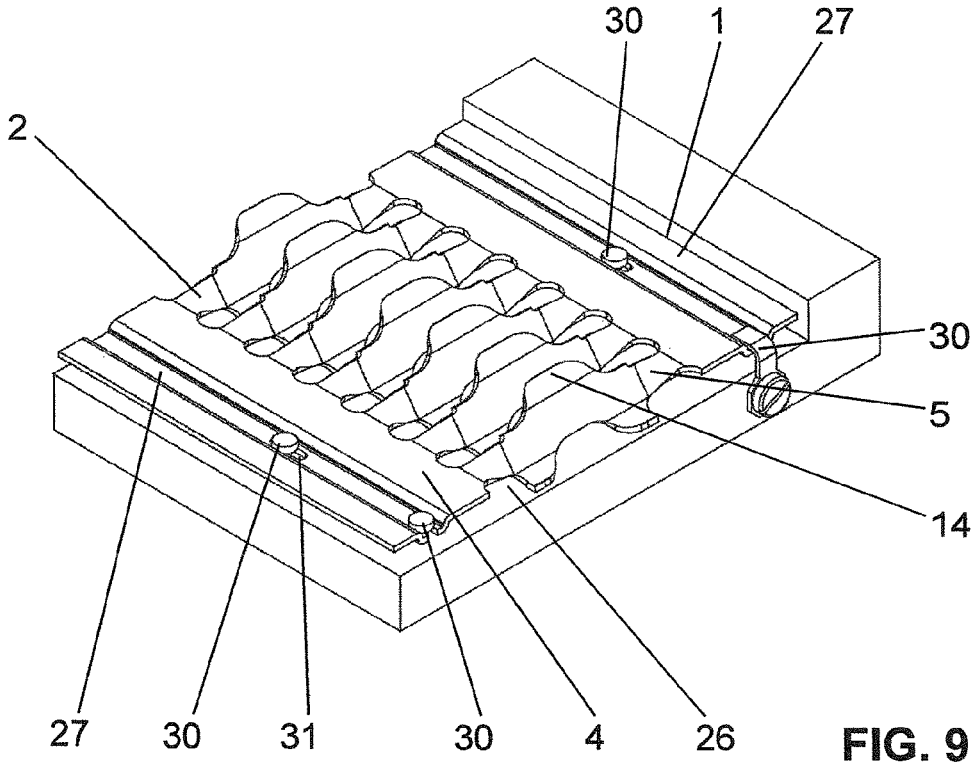
FIG. 9 shows an exemplary view of a situation of installation with securing elements in accordance with various embodiments.
Figure 10:
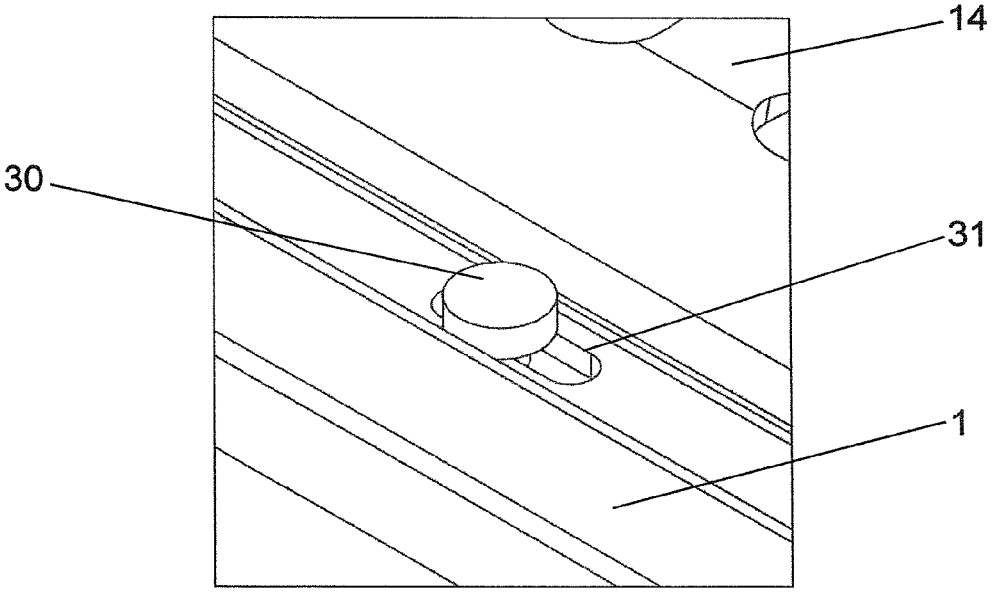
FIG. 10 shows a detailed view of a contact element in accordance with the above figures with a securing element in accordance with a first embodiment.

An exemplary situation of installation of the contact element 1 in accordance with the above description in a contact part or conductor 25 is shown in FIG. 9. The contact part 25 here comprises a recess 26 with a rectangular cross section, in which the contact element 1 is mounted. The contact element 1 is secured here additionally in relation to the contact part 25 by a securing means 30. A number of conceivable securing means 30 are shown in FIG. 7, which can be used either in isolation or in combination with one another.

The securing means 30 may be, for example, a screw or a rivet, which is guided through openings 31 arranged in the strips. The openings can be arranged for example in the reinforcing corrugations 27 or directly on the strip 2, 3. The openings preferably have the form of slots extending in the longitudinal axis L. Such a slot 31 is illustrated in FIG. 8.

Figure 11:
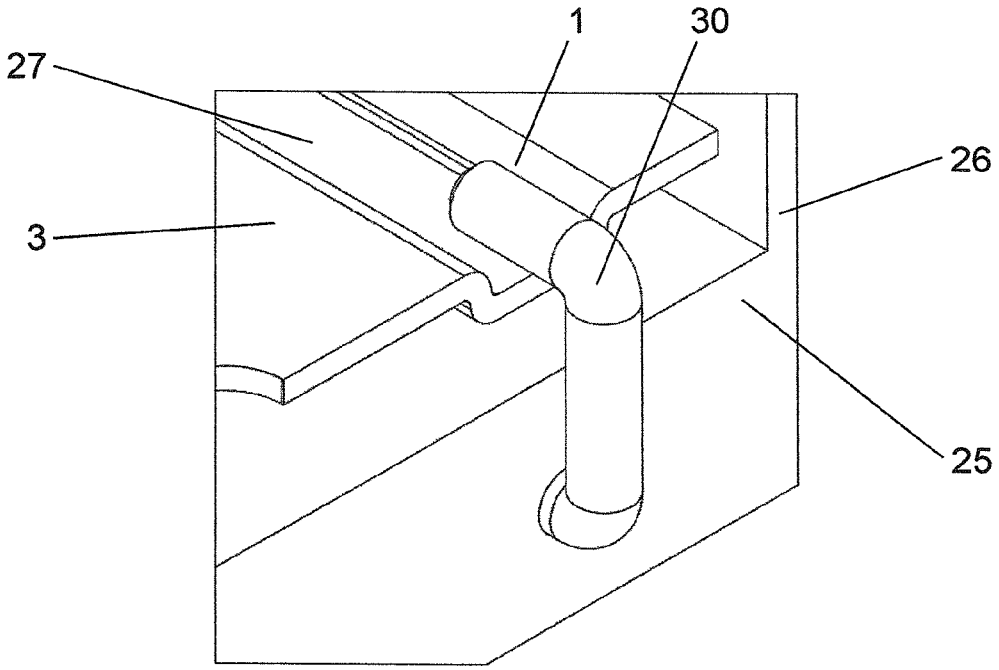
FIG. 11 shows a detailed view of a contact element in accordance with the above figures with a securing element in accordance with a second embodiment.
Figure 12:
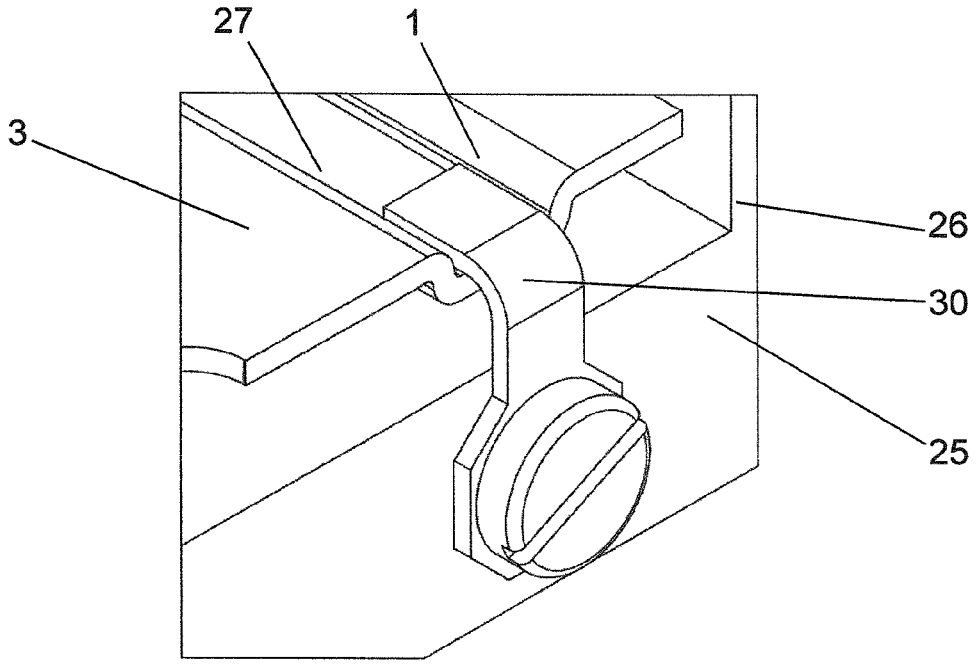
FIG. 12 shows a detailed view of a contact element in accordance with the above figures with a securing element in accordance with a third embodiment.

The securing means, however, may also have the form of a retaining clip 30, which, as shown in FIGS. 11 and 12, acts on the strips 2, 3 or the reinforcing corrugations 27.

LIST OF REFERENCE SIGNS

1 contact element
2 strip
3 strip
4 torsion portion
5 torsion portion
6 first contact portion
7 second contact portion
8 front web edge
9 rear web edge
10 bulge
11 indentation
12 front side portion
13 rear web portion
14 webs
15 apertures
16 rounded connection portion
17 rounded connection portion
18 front portion
19 rear portion
20 side portion
21 side portion
22 transition region
23 apex
24 torsion line
25 contact part
26 recess
27 reinforcing corrugation
28 rear side portion
29 junction point
30 securing means
31 opening
32 socket
34 plug

The invention claimed is:

1. A contact element for establishing electrical contact between two electrical conductors or contact parts, comprising at least two strips extending parallel to one another and in the direction of a longitudinal axis and a row of webs, which are arranged between the strips and are contiguous with the strips, wherein the webs are connected resiliently via a first torsion portion to one of the strips and via a second torsion portion to another of the strips and are inclined with respect to the strips in the deformed state, such that a first contact portion extends above the strip and a second contact portion extends below the strip, wherein the webs each have a front web edge and a rear web edge, which front web edge has a bulge and which rear web edge has an indentation, which fits or is complementary to the bulge of a directly adjacent web edge, wherein the bulge provides said first contact portion, wherein the webs, to the side of the indentation, have two rear web portions, which provide the second contact portion, wherein the front web edge and the rear web edge extend from the first torsion portion to the second torsion portion, and wherein the front web edge and the rear web edge of two directly adjacent webs contact one another in the undeformed state over their entire length, in particular at least approximately, and wherein in the undeformed state the front side portion and the rear side portion of adjacent webs lead jointly into a common aperture, wherein the front side portion and the rear side portion of said adjacent webs, in the region of the junction, extend into the common aperture at right angles to the strips.

2. The contact element as claimed in claim 1, wherein the front web edge and the rear web edge extend parallel to one another and/or in a manner complementary to one another.

3. The contact element as claimed in claim 1, wherein the front web edge and the rear web edge have an identical course, wherein the distance between the front web edge and the rear web edge is constant over the entire web width from the first torsion portion to the second torsion portion, as viewed in the longitudinal axis.

4. The contact element as claimed in claim 1, wherein the torsion portion is provided by a series of apertures arranged at regular distances from one another, wherein the torsion portion is formed in the region between two apertures arranged in direct succession in the longitudinal axis and adjacently, and wherein, in a transverse direction, which extends at right angles to the longitudinal axis, the torsion portion extends over the maximum width of the aperture in the same direction.

5. The contact element as claimed in claim 1, wherein the front web edge extends rearwardly from the bulge on either side of this bulge and defines a front side portion, which extends in portions substantially at right angles to the longitudinal axis, wherein the rear web edge extends rearwardly from the indentation on either side of this indentation and defines a rear side portion, which extends in portions substantially at right angles to the longitudinal axis.

6. The contact element as claimed in claim 1, wherein the front web edge transitions from the bulge to the front side portion via a rounded connection portion, and wherein the rear web edge transitions from the indentation to the rear side portion via a rounded connection portion.

7. The contact element as claimed in claim 4, wherein the web edges of two directly adjacent webs contacting one another lead jointly into the same aperture in the region of the one strip and in the region of the other strip.

8. The contact element as claimed in claim 4, wherein the aperture has a front portion and a rear portion, wherein the front portion and the rear portion preferably extend at right angles to the strips, and wherein the front portion and the rear portion are connected via two side portions, which preferably extend parallel to the strips, and wherein the transition regions between the portions delimiting the aperture are preferably formed with a rounded portion.

9. The contact element as claimed in claim 8, wherein the front web edge and the rear web edge or the side portions of the web edges, respectively, lead into the aperture in the region of the side portion of the aperture, but preferably not in the region of the rounded portion.

10. The contact element as claimed in claim 1, wherein the webs arranged in direct succession along the strips are separated from one another in the region of the web edges by cuts made without material removal and contact one another in the undeformed state at least approximately.

11. The contact element as claimed in claim 1, wherein the bulge has an apex centrally between the two strips, and wherein a torsion line extends centrally through the torsion portion and at right angles to the longitudinal axis, wherein the distance between apex and torsion line in the direction of the longitudinal axis is substantially equal to the distance between torsion line and the rear web edge in the region of the rear web portions in the direction of the longitudinal axis, or wherein the distance between apex and torsion line in the direction of the longitudinal axis is greater or smaller by a factor in the range of 1.0 and 1.3, in particular 1.15 to 1.25, than the distance between torsion line and the rear web edge in the region of the rear web portions in the direction of the longitudinal axis.

12. The contact element as claimed in claim 1, wherein the torsion portions are deformed via a twisting during the production, and wherein the web substantially forms an even plane between the two torsion portions, apart from the bulge and the web portion extending to the side of the indentation, said even plane being arranged at an angle to the strips.

13. The contact element as claimed in claim 12, wherein the bulge and/or the web portions are curved via a curvature with respect to the even plane.

14. The contact element as claimed in claim 1, wherein the strips are provided with a reinforcing corrugation, which extends in the direction of the longitudinal axis, wherein the reinforcing corrugation preferably has a u-shaped cross section and/or preferably a rectangular cross section and/or preferably a rounded cross section.

15. The contact element as claimed in claim 14, wherein the height of the reinforcing corrugation in a direction perpendicular to the surface of the strip is less than the extent of the web in the corresponding direction with maximum deflection of the web.

16. The contact element as claimed in claim 1, wherein the contact element consists of a beryllium-free metal alloy, in particular of a beryllium-free copper alloy.

17. A contact arrangement comprising a first contact part and a second contact part to be electrically conductively connected to the first contact part, wherein one of the contact parts comprises a recess extending from a surface of the contact part into the contact part for accommodating the contact element as claimed in claim 1, wherein the recess preferably has a rectangular cross section.

18. The contact arrangement as claimed in claim 17, wherein the first contact part has the form of a socket, and wherein the second contact part has the form of a plug fitting the socket, such that a plug and socket connection can be provided, wherein the recess lies either in the socket or on the plug.

19. The contact arrangement as claimed in claim 17, wherein the contact element is secured in the recess via a securing means, such as a screw, a rivet or a retaining clip.

* * * * *